United States Patent [19]

Rarey et al.

[11] 4,041,901

[45] Aug. 16, 1977

[54] APPARATUS FOR ELECTROSTATIC PRINTING OR COATING AND DEVELOPER MIX CIRCULATING SYSTEM

[75] Inventors: Kenneth W. Rarey, South Holland; Edward D. Higgins, Palos Heights; Donald L. Hungerford; John B. Kennedy, Jr., both of Chicago, all of Ill.

[73] Assignee: Continental Can Co., Inc., Chicago, Ill.

[21] Appl. No.: 445,289

[22] Filed: Feb. 22, 1974

Related U.S. Application Data

[63] Continuation of Ser. No. 791,098, Jan. 14, 1969, abandoned.

[51] Int. Cl.[2] ..... B05B 5/08

[52] U.S. Cl. ..... 118/621; 118/627; 118/658; 427/18; 427/25

[58] Field of Search ..... 118/637, 627, 623, 624, 118/627, 629, 638, 621, 623, 629, 630; 117/17.5; 355/3 DD; 346/74 ES, 74 EB; 101/DIG. 13; 313/361; 317/3; 427/18, 21, 25, 27, 30, 32, 33

[56] References Cited

U.S. PATENT DOCUMENTS

| | | | |
|---|---|---|---|
| 2,408,143 | 9/1946 | Huebner | 118/625 X |
| 3,180,239 | 4/1965 | Shearer et al. | 118/637 X |
| 3,202,092 | 8/1965 | Childress | 427/18 X |
| 3,306,193 | 2/1967 | Rarey et al. | 118/637 X |
| 3,330,901 | 7/1967 | Adrenne et al. | 313/361 X |
| 3,557,751 | 1/1971 | Kushima | 118/637 |
| 3,713,862 | 1/1973 | Winkless | 118/624 X |

*Primary Examiner*—Mervin Stein

*Attorney, Agent, or Firm*—Diller, Brown, Ramik & Wight

[57] ABSTRACT

Electrostatic printing or coating apparatus including a main drum for transporting developer mix to an application or printing zone and having permanent magnet segments mounted within the drum for attracting developer mix to its exterior surface. An electric field is produced in the printing zone to provide movement of developer particles toward the article to be printed or coated and a field producing electrode is mounted within the drum adjacent the printing zone. A container conveyor extends past the printing zone to provide positioning of container portions to be coated, and a further drum having interior permanent magnet segment is positioned to remove developer mix from the main drum. The further drum may be rotated in the rotational direction opposite that of the main drum to reduce developer turbulence. Removal of the developer mix from the apparatus may be effected by a member pivotally mounted to open an aperture and having an edge engageable with a movable developer mix carrying member to provide diversion of the mix through the aperture.

31 Claims, 12 Drawing Figures

INVENTORS
KENNETH W. RAREY,
EDWARD D. HIGGINS,
DONALD L. HUNGERFORD
& JOHN B. KENNEDY, Jr.
BY Mason, Parter, Diller & Brown
ATTORNEYS INVENTORS
KENNETH W. RAREY,
EDWARD D. HIGGINS,
DONALD L. HUNGERFORD
& JOHN B. KENNEDY, Jr.
BY Mason, Porter, Weiler & Brown
ATTORNEYS INVENTORS
KENNETH W. RAREY,
EDWARD D. HIGGINS,
DONALD L. HUNGERFORD
& JOHN B. KENNEDY, Jr.
BY Mason, Porter, Dillon & Brown
ATTORNEYS INVENTORS
KENNETH W. RAREY,
EDWARD D. HIGGINS,
DONALD L. HUNGERFORD
& JOHN B. KENNEDY, Jr.
BY Mason, Porter, Dillon & Brown
ATTORNEYS INVENTORS
KENNETH W. RAREY,
EDWARD D. HIGGINS,
DONALD L. HUNGERFORD
& JOHN B. KENNEDY, Jr.
BY Mason, Porter, Deller & Brown
ATTORNEYS INVENTORS
KENNETH W. RAREY,
EDWARD D. HIGGINS,
DONALD L. HUNGERFORD
& JOHN B. KENNEDY, Jr
BY Mason, Carter, Miller & Brown
ATTORNEYS INVENTORS
KENNETH W. RAREY,
EDWARD D. HIGGINS,
DONALD L. HUNGERFORD
& JOHN B. KENNEDY, JR.
BY Mason, Porter, Lieu & Brown
ATTORNEYS

APPARATUS FOR ELECTROSTATIC PRINTING OR COATING AND DEVELOPER MIX CIRCULATING SYSTEM

This is a continuation of Application Ser. No. 791,098, filed Jan. 14, 1969, and now abandoned.

This invention relates generally to apparatus for electrostatic printing or coating, and more particularly to apparatus wherein tone particles from a developer mix of toner and carrier particles are continually deposited upon conveyed articles.

It is an object of this invention to provide apparatus for electrostatic printing or coating wherein developer particles are conveyed to a printing zone and electrostatically applied to articles serially conveyed through the application or printing zone.

It is a further object of this invention to provide an apparatus for electrostatic printing or coating, an improved developer transporting system for moving developer to an application zone in which articles are to be printed or coated.

A further object of this invention is to provide developer transporting provisions in accordance with the immediately foregoing object and including a drum having an exterior developer supporting surface in combination with an internally mounted magnet or magnets for attracting developer to the surface and wherein relative rotation between the drum and magnet or magnets is provided to effect developer movement.

Yet another object of this invention is to provide a developer recirculation path including at least one drum and magnet combination altering the path of movement of developer mix for recirculation and re-use in subsequent printing or coating operations.

Another object of this invention is to overcome the divergence of toner particles during application thereof in a printing or coating zone by focussing of the electric field in the printing or coating zone.

A still further object of this invention is to provide a reduction in turbulence and grinding of developer during movement thereof to reduce aging of carrier particles.

Additionally, it is an object of this invention to provided efficient developer removal from a printing or coating device by including a pivotally mounted member positioned to open and close an aperture communicating with the exterior of the printing or coating device and having an edge thereon engageable with a movable developer carrying member to effect diversion of developer through the associated aperture.

It is further an object of this invention to provide in combination with an electrostatic printing or coating device, article or container conveying provisions extending to and from a printing or coating zone and providing the efficient continual electrostatic application of toner to the conveyed articles or containers.

With the above and other objects in view that will hereinafter appear, the nature of the invention will be more clearly understood by reference to the following detailed description, the appended claims, and the several views illustrated in the accompanying drawings.

IN THE DRAWINGS:

FIG. 1 is a top plan view of combined container conveying provisions and electrostatic printing or coating apparatus in accordance with this invention, and illustrates a pair of container conveying belts or chains, associated container guide rails and a screened opening communicating with the interior of an electrostatic printing or coating device for applying toner to conveyed containers.

FIG. 2 is a simplified cross-sectional view of an electrostatic printing or coating device of the type shown in FIG. 1, and diagrammatically illustrates a rotatable main developer transporting drum for carrying developer mix on the exterior surface thereof to a toner application zone, magnet provisions mounted within the main drum for attracting developer to the surface thereof, a first field production electrode within the main drum for the establishment of an electric field in the toner application zone and a secondary developer transporting drum with interiorly mounted magnet provisions for transporing toner-deficient developer away from the main drum for the replenishment of toner particles in the developer mix prior to the further employment of the developer in subsequent coating or printing operations.

Figure 4:
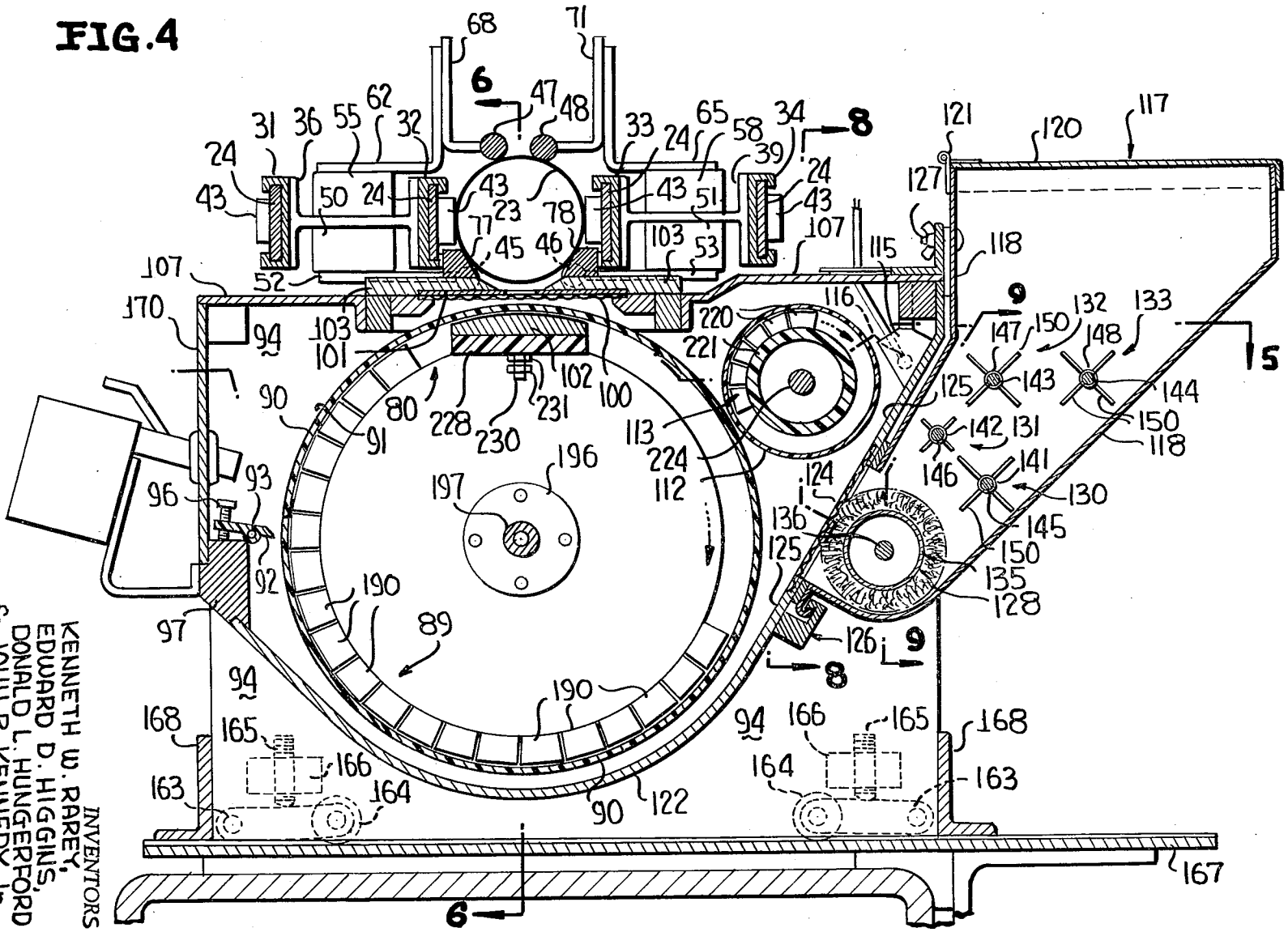
FIG. 4 is an enlarged fragmentary cross-sectional view taken along the line 4—4 of FIG. 1 and illustrates the container conveying provisions including upper container-grounding guide rails, the main and secondary rotatable drums and toner replenishing provisions including a toner reservoir and associated rotatable toner supply brush.
Figures 11, 12:
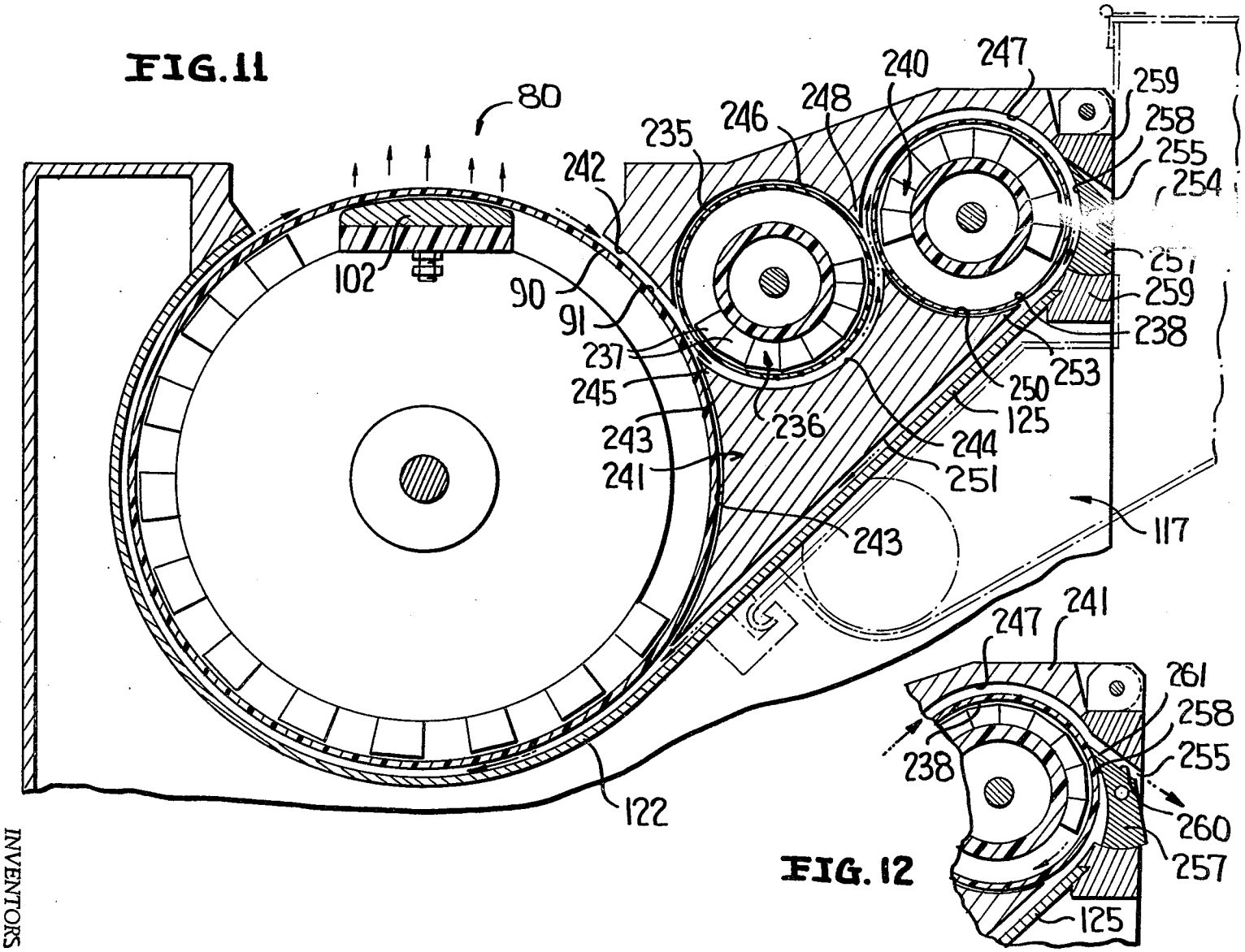

FIG. 11 is an enlarged fragmentary cross-sectional view similar to FIG. 4 and illustrates a further embodiment of the developer transporting system according to this invention including main and secondary developer transporting drums rotatable in opposite rotational directions, a further developer transporting drum rotatable in opposite rotational direction with respect to the secondary drum, and a pivotally mounted developer removal member.

FIG. 12 is a fragmentary cross-sectional view of the developer removal member of FIG. 11 in assocaition with the rotatable third or further drum and illustrates the cooperation of an edge portion of the developer removal member with the exterior surface of the adjacent drum for diverting developer through an aperture to the exterior of the printing or coating apparatus.

Figure 1:
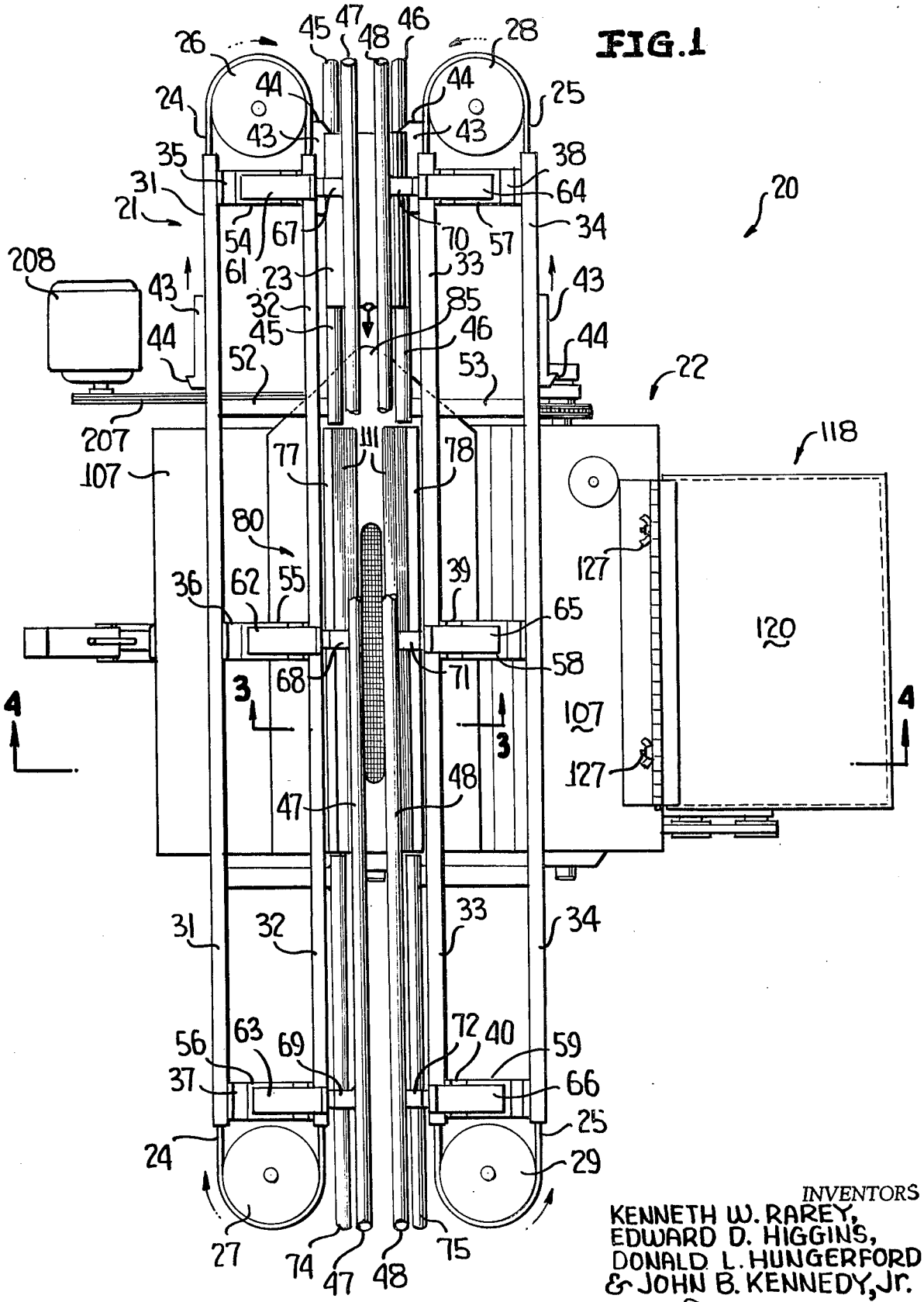

Referring now to the drawings in detail, there is illustrated in FIG. 1 novel container side seam coating apparatus generally referred to by the numeral 20 including a container conveying means 21 and an associated electrostatic printing or coating device 22 for the electrostatic application of toner particles to conveyed containers.

The electrostatic printing or coating device 22 may be employed in the production of a predetermined printed image or in the application of coatings to a wide variety of articles and numerous novel arrangements incorporated within the coating or printing device 22, to be discussed more fully hereinbelow, are applicable to a wide variety of electrostatic processes wherein toner particles are applied in a desired fashion to an article or substrate. However, the combined conveying means 21 and electrostatic printing or coating device 22 which, in combination, is designated by the numeral 20 in FIG. 1 is particularly applicable to the coating of side seams in tubular container bodies such as, for example, the can body 23 illustrated in FIG. 1.

In metal container formation, it is common to form a container body by the bringing together of container body blank edges which are mechanically lapped and locked to form a container side seam which is subsequently sealed and bonded with solder. Additionally, it is possible to form metal container bodies by the lapping and welding of edge portions to form the container side seam.

In the case of soldered container side seams, it has been common to protect the exterior of the side seam from unsightly corrosion by the application of a solvent type clear coating. In the case of welded side seams, however, difficulties have been encountered in the satisfactory coating of the side seam resultant from the presence of exposed sharp edges which often prevent the formation of a solvent type coating continuous across such sharp edges.

The electrostatic deposition of toner particles upon container side seams allows the application of material of sufficient thickness as to completely cover sharp edges of welded side seams. Dry powder coating materials, then, may be applied and heat fused or cured after application and the employed powder or toner may be pigmented to a desired color so as to hide the coated side seam and the coating material may either match or contrast with the adjoining container body decoration. The electrostatic deposition of container side seam coating materials is applicable to container bodies having either welded or soldered side seams and the "stripe" so formed is clearly defined by sharp straight edges on each side thereof.

The container conveying means 21 illustrated in FIG. 1 includes a pair of endless container conveying belts 24 and 25 entrained, respectively, about pairs of pulleys 26, 27 and 28, 29. The belts 24 and 25 are supported and guided along their lengths by a plurality of elongate channelled guide members 31-34 and the belts 24 and 25 are driven in the directions indicated by the unnumbered arrows adjacent the guide members 31 and 34 in FIG. 1. A plurality of frame members 35-37 support the elongate channelled guide members 31 and 32 along the length thereof, the central frame member 36 being best illustrated in FIG. 4. Similarly, a plurality of frame members 38-40 support the channelled guide members 33 and 34 along their lengths and the central frame member 39 is best seen in FIG. 4.

Affixed to the belts 24 and 25 along their respective lengths are a plurality of container engaging shoes 43 having enlarged container engaging end portions 44 formed thereon for engaging the trailing end of the containers 23 to effect movement of the containers axially along the container conveying means 21 past the electrostatic printing or coating device 22.

Container guidance is initially effected by a pair of lower container guide rails 45 and 46 and a pair of upper container guide rails 47 and 48, each of which guide rails extends toward the printing or coating device 22 from a point remote therefrom. The spacing of the guide rails 45-48 conforms approximately with the exterior configuration of the conveyed container and the lower rails 45 and 46 are supported upon the frame members 35 and 38 and appropriately spaced by a pair of spacer blocks 50 and 51 having affixed thereto a pair of vertically extending support members (not shown) similar to the vertically extending support members 52 and 53 supporting the lower guide rails 45 and 46 at their ends closest the printing device 22. Similarly, the upper guide rails 47 and 48 which extend the entire length of the side seam coating apparatus 20 are supported by the frame members 35–40 through the provision of upper spacer blocks 54–59, support brackets 61–66 and adjoining brackets 67–72, the blocks 55, 58 and brackets 62, 65, 68 and 71 again being best seen in FIG. 4.

Similarly, upon conveyance of a container 23 away from the printing or coating device 22, a further pair of lower guide rails 74 and 75, mounted in a fashion similar to the mounting of the lower guide rails 45 and 46, cooperate with the upper guide rails 47 and 48 for support and guidance of the conveyed containers.

Figure 3:
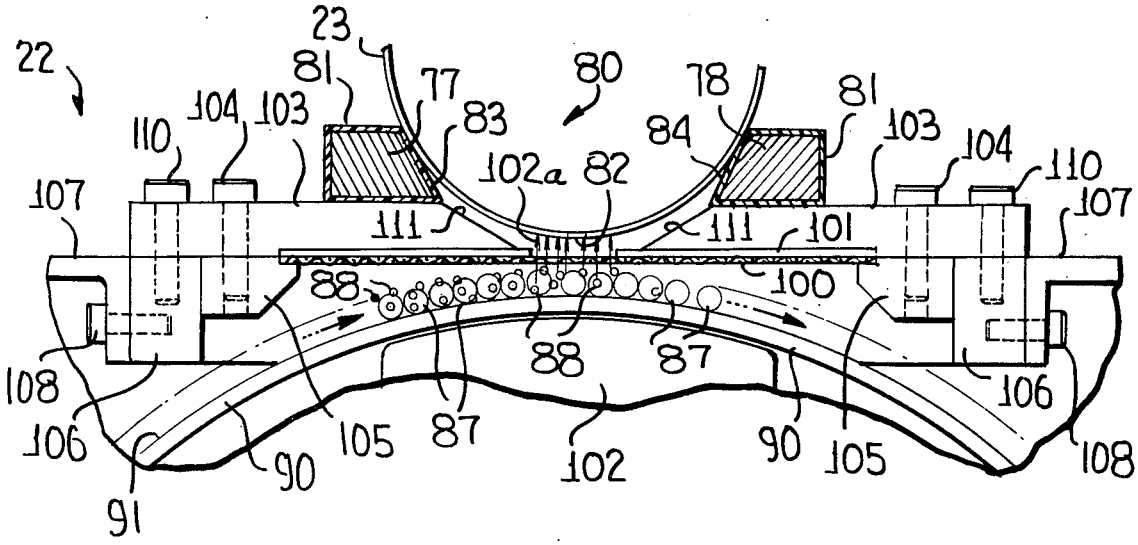
FIG. 3 is an enlarged fragmentary cross-sectional view taken along the line 3—3 of FIG. 1 and shows the location of a container with respect to the toner application zone, a pair of insulated container guide rails an beveled field convergence producing support members in association with a carrier particle-blocking screen electrode.

During movement of containers 23 past the coating or printing device 22, a pair of centrally located lower guide bars 77 and 78 engage the containers to provide precise vertical positioning of the containers during their movement through a printing zone generally indicated by the numeral 80. The guide bars 77 and 78 are each provided with a coating or covering of insulating materials 81 as shown in FIG. 3, electrically isolating the containers 23 with respect to potentials employed in the application of toner particles to a container side seam area 82, such potentials being discussed more fully hereinafter. The guide bars 77 and 78 are provided with inclined container guide surfaces 83 and 84, respectively, which engage the sides of the containers 23 during their passage through the printing zone 80. Preferably, the insulating coatings or coverings 81 are of Teflon or other low-friction materials, assuring relatively smooth sliding movement of the containers 23 through the printing zone 80.

Figure 6:
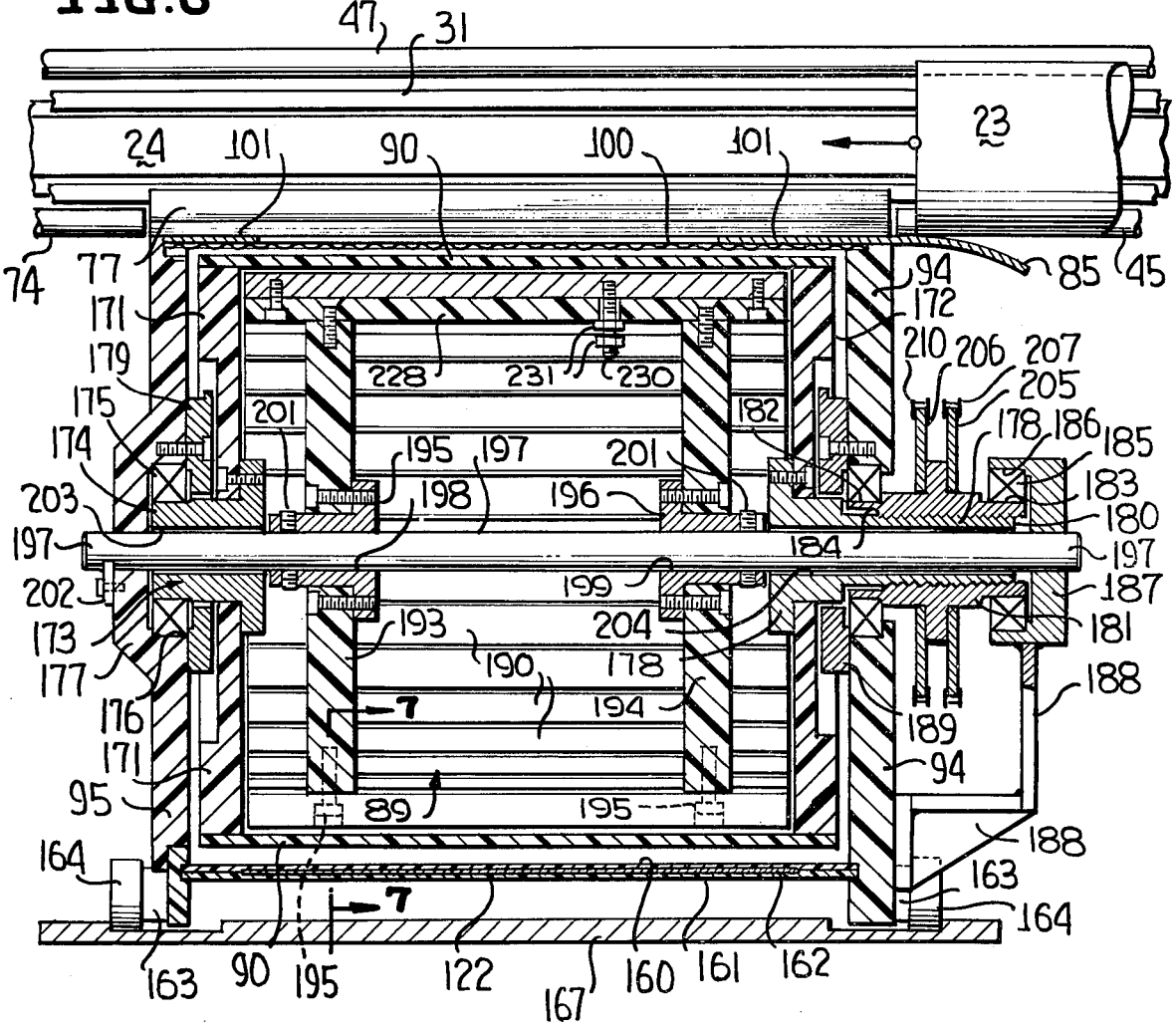
FIG. 6 is a fragmentary cross-sectional view taken along the line 6—6 of FIG. 4, and shows the mounting provisions for the magnet arrangement located within the main developer transporting drum in addition to the mounting and rotation providing provisions for the main drum.

From FIGS. 1 and 6, it will be noted that movement of conveyed containers from the lower guide rails 45 and 46 onto the lower guide bars 77 and 78 is facilitated by a flexible lead-in ramp 85 which engages the lower leading edge of the containers 23, lifting the container side seam area for proper engagement of the container sides with the guide bars 77 and 78. The lead-in ramp 85, then, assures proper initial container positioning by contacting the lowermost surfaces of improperly positioned containers and containers having an excessive pear-shape and facilitates smooth transition of the container bodies onto the guide bars 77 and 78.

Figure 5:
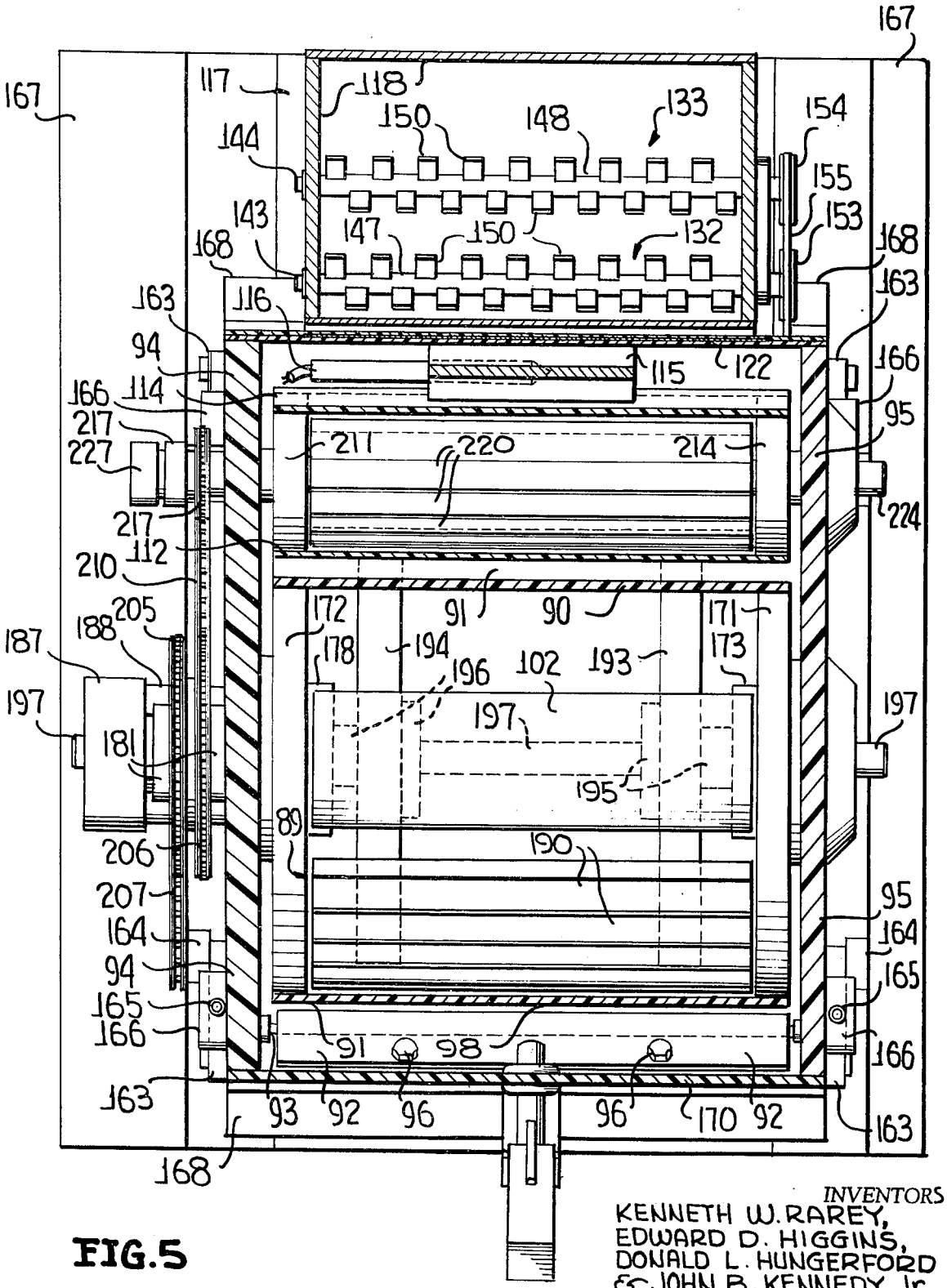
FIG. 5 is a cross-sectional view taken along the line 5—5 of FIG. 4 and illustrates the mounting and rotating provisions associated with the main and secondary developer transporting drums.

The printing or coating device 22 employs a developer mix including developer particles best seen in FIG. 3 and including carrier particles 87 of magnetic material and toner particles 88 of known commercially available or suitably selected material carried in adhering relation to the carrier particles 87 for application to the container side seam area 82 of the containers 23. Transportation of the developer mix into the printing or coating area 80 is provided by a rotatably mounted drum 90 having an exterior surface 91 for supporting the developer particles thereon during movement toward the printing or coating zone 80. Preferably, the drum 90 is of thin insulating material and encloses therein arcuately arranged magnet means generally indicated by the numeral 89 in FIG. 2. The magnet means 89 attract the developer particles to the exterior surface 91 of the drum 90 and maintain the developer particles in supported relation upon the drum during rotation of the drum. The frictional engagement of the developer upon the exterior surface 91 of the drum 90 provides movement of the developer with the drum during rotation thereof and a doctor blade 92 may be located proximate the exterior surface 91 of the drum 90 to determine the thickness of the layer of developer transported to the printing or coating zone 80. The doctor blade 92 extends the full width of the drum 90 and is preferably pivotally mounted by a transversely extending mounting rod 93 extending between and supported by a pair of side plates 94 and 95 as best illustrated in FIGS. 4 and 5. Adjusting provisions such as the threaded studs 96 engageable with a support member 97 may be provided upon the pivotally mounted doctor blade 92 for exact adjustment of the spacer 98 between the exterior surface 91 of the drum 90 and the transversely extending edge of the doctor blade.

In the printing or coating zone 80, as best seen in FIG. 3, a screen electrode 100 is mounted between the drum 90 and the location at which the containers 23 have toner particles applied thereto. A masking member 101 overlies the screen electrode 100 and defines an open area 102*a* for the passage of toner particles therethrough into contact with the side seam area 82 of the containers 23. The masking member 101, then, determines the width of the area upon the containers 23 to which toner is applied. While the screen electrode 100 may be masked by the application thereto of coating material in predetermined areas as is known in the art, the provision of the separate masking member 101 facilitates removal of the screen electrode 100 for cleaning or replacement thereof. The screen electrode 100 is of sufficiently fine mesh to prevent passage therethrough of the carrier particles 87 while permitting the free passage of the toner particles 88 into contact with the containers 23. Within the drum 90 proximate the printing or coating zone 80, a first field producing electrode 102 is mounted. The screen electrode 100 and the first field producing electrode 102 are energized at differeing potentials, to be discussed more fully hereinafter and establish therebetween an electric field extending through the rotatable drum 90.

The screen electrode 100 and the masking member 101 are supported by mounting provisions including a pair of upper mounting plates 103 having affixed thereto, as by the threaded members 104, a pair of longitudinally extending mounting bars 105 supporting the screen electrode 100 and masking member 101 at opposite edges thereof. A pair of further supporting members 106, affixed to a pair of upper housing members 107 as by the threaded members 108, supports the plates 103 and may be affixed thereto as by the additional threaded members 110 best illustraded in FIG. 3.

The conveyed containers 23 are maintained at a further potential differing from the potential of the screen electrode 100 as by electrical connection through the upper guide rails 47 and 48 and, thus, the conveyed containers 23 constitute a further electrode in the printing or coating zone 80, attracting toner particles thereto. As mentioned hereinabove, the containers 23 are electrically isolated from the plates 103 by the coating or layer of insulating material 81 upon the guide bars 77 and 78. The upper mounting plates 103 contacting the masking member 101 are maintained at the same potential as the screen electrode 100 and include beveled or inclined edge portions 111 proximate the printing or coating area 80. The inclined edge portions 111 of the plates 103 define an opening through which the toner particles 88 pass. Because of the electrical charges upon the toner particles 88, these particles tend to diverge when freely moving between the exterior surface 91 of the drum 90 and the container side seam area 82. The beveled or inclined edge portions 111 provided upon the upper mounting plates 103 effect convergence of the electrical field produced between the screen electrode 100 and the container 23, overcoming the divergent tendencies of the toner particles 88 and allow the precise depositing of a predetermined width of a covering of toner particles 88 upon the side seam area 82 of the container 23. The coated area, then, is precisely defined by sharp straight edges extending the length of the container body.

Figure 2:
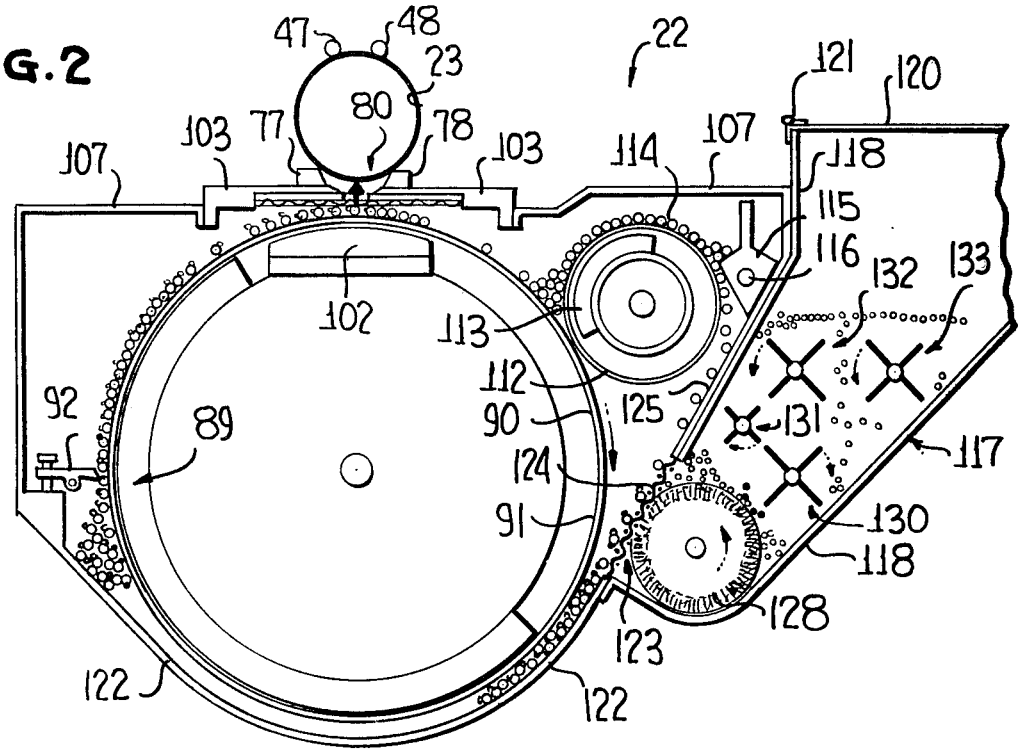

Toner-deficient developer from which toner has been removed in the printing or coating zone 80 is transported away from the zone 80 upon the exterior surface 91 of the drum 90 and into proximity with a further or secondary rotatably mounted drum 112, shown in FIG. 2, having arcuately extending magnet means 118 mounted within the interior thereof. Inasmuch as there is no magnetic means mounnted within the main drum 90 proximate the secondary drum 112, the arcuately extending magnet means 113 within the secondary drum 112 attracts the toner-deficient developer from the exterior surface 91 of the drum 90 and onto an exterior surface 114 of the secondary drum 112 whereupon rotation of the drum 112 as indicated in FIG. 2 effects movement of the developer away from the main drum 91 for the subsequent replenishment of toner thereto.

The developer is discharged from the exterior surface 114 of the secondary drum 112 by momentum and natural gravitational forces, a portion of the discharged toner entering a trough 115, within which is mounted a probe 116 for electrically determining the ratio of carrier to toner particles within the mix passing therethrough.

A toner reservoir, generally indicated by the numeral 117, is mounted adjacent the path of flow of the developer mix discharged from the surface of the secondary drum 112 and includes a housing 118 terminating upwardly in an open end closed by a lid member 120 hingedly connected to the housing 118 as at the hinge 121.

The reservoir 117 is mounted upon a central chute member 122 of the main developer device housing and communicates with the interior of the chute member 122 via an opening 123 across which extends a screen 124 permitting the passage of toner particles therethrough. The reservoir 117 is affixed to the central chute member 122 at an inclined portion 125 thereof along which the developer flows. As best seen in FIG. 4, the resevoir 117 may be attached to the central chute member 122 by pivotal connection provisions generally indicated by the numeral 126 and appropriately selected upper fastening members 127. Release of the fastening members 127 allows pivotal movement of the reservoir 117 away from the inclined portion 125 of the central chute member 122 to allow cleaning or replacement of the screen 124.

Mounted within the reservoir 117 is a rotatable brush 128 which, upon rotation, supplies toner particles from the interior of the reservoir 117 to the developer mix flowing along the inner surface of the inclined portion 125 of the central chute member 122. A plurality of rotatable paddle provisions 130–133 are mounted within the interior of the resevoir 117 for agitation of the mass of toner enclosed within the reservoir, breaking agglomerations of toner particles and assuring even distribution of toner through the screen 124.

Figure 9:
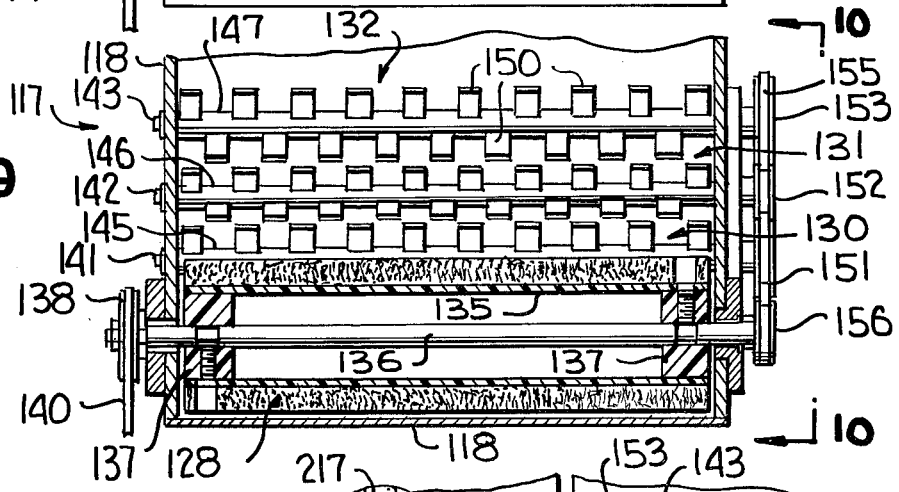
FIG. 9 is a cross-sectional view taken along the line 9—9 of FIG. 4 and shows a plurality of rotatable paddles mounted within the toner reservoir for precluding the formation of agglomerations of toner, and mounting provisions for the rotatable toner dispensing brush.

As best illustrated in FIGS. 4 and 9, the brush 128 includes a central rotatable tubular member 135 mounted upon an axially located shaft 136 by spaced annular support member 137 affixed to the shaft 136. A pulley 138 affixed to one end of the shaft 136 has entrained thereabout a belt 140 driven from a suitably selected motive source (not shown) for driving the brush 128 to effect toner replenishment. Rotation of the drum 128 may be electrically controlled from the probe or sensor 116 mounted within the trough 115 to provide toner replenishment when the ratio of carrier to toner particles within the developer mix exceeds a predetermined optimum value.

Figure 10:
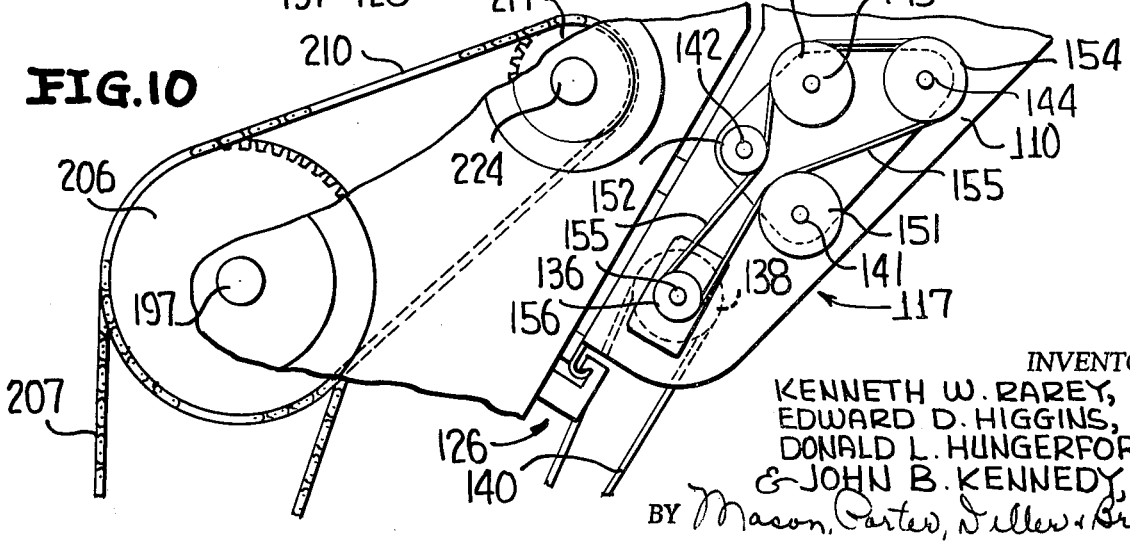
FIG. 10 is an enlarged fragmentary elevational view taken along the line 10—10 of FIG. 9 with parts broken away for clarity and more clearly illustrates chain drive provisions for the main and secondary rotatable drums and belt drive provisions for the rotatable paddles within the toner reservoir.

As best illustrated in FIGS. 5, 9 and 10, the paddle provisions 130–133 include transversely extending shafts 141–144, respectively, mounted between the sides of the reservoir 117 for rotation therein. Four sleeves 145–148 are mounted upon the shafts 141–144, respectively, and a plurality of paddles 150 extend from each of the sleeves 145–148 for rotation with the sleeves and associated shafts.

A set of pulleys 151–154, best illustrated in FIG. 10, are mounted upon ends of the shafts 141–144, respectively, and a belt 155 is entrained into engagement with each of the pulleys 151–154 and is driven from a further pulley 156 mounted upon the brush supporting shaft 136 at the opposite end thereof from the pulley 138 and belt 140 which imparts rotational movement to the brush 128. Driving of the brush 128 by the belt 140 and pulley 138, then, effects rotation of the paddle provisions 130–133.

Figure 7:
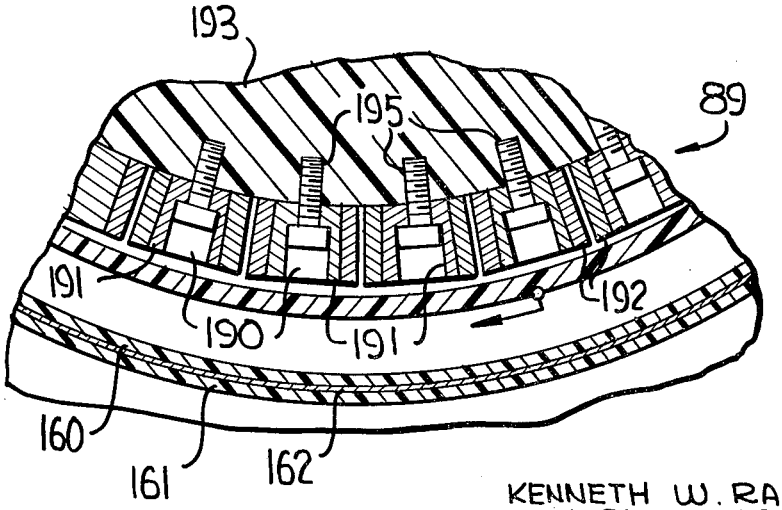
FIG. 7 is an enlarged fragmentary cross-sectional view taken along the line 7—7 of FIG. 6 and better illustrates the magnet provisions mounted within the main drum including a plurality of segments, each having central permanent magnet portions and pole pieces of magnetic material.

The central chute member 122 is supported between the side plates 94 and 95 which may be of insulating material, as shown, or which may be metallic having a covering of insulating material applied thereto. The central chute member 122 may include inner and outer layers of insulating material 160 and 161, respectively, sandwiching therebetween a metallic layer 162 as best illustrated in FIGS. 6 and 7. The central metallic layer 162 may be provided with an electrical connection allowing the metallic layer to be employed in the electrical shielding of the interior of the printing device 22. The side plates 94 and 95 are supported at each of their lowermost corners by levelling provisions including pivotally mounted levers 163 having rollers 164 mounted upon the free ends thereof. Threaded studs 165 extend through lugs 166 affixed to the side plates 94 and 95 and the threaded studs 165 abut the levers 163 for varying the position thereof. The rollers 164 rest upon a mounting frame member 167 and adjustment of the threaded studs 165 is employed in the levelling of the printing or coating device 22. The side plates 94 and 95 are joined by laterally extending angle irons 168. The remainder of the housing enclosing the main and secondary drums is provided by a generally vertically upstanding wall portion 170 and the upper horizontally disposed members 107.

The main developer transporting drum 90 is supported between the side plates 94 and 95 as best illustrated in FIG. 6 by a pair of circular plates 171 and 172 which may be phenolic or of other suitably selected material. The plate 171 is affixed to a flanged mounting member 173 having an end portion 174 of reduced diameter and freely rotatably supported within bearings 175 which, in turn, are supported by a cylindrical surface 176 provided in a bearing housing portion 177 of the side plate 95 to which is affixed a bearing retaining plate 179. The drum supporting plate 172 is affixed to a central flanged spline 178 having an extended threaded portion 180 of reduced diameter extending well beyond the side plate 94 to the exterior of the printing or coating device. An interiorly threaded female support member 181 is threaded onto the spline portion 180 and includes at each end thereof bearing support surfaces 182 and 183 of reduced diameter. A first bearing assembly 184 is mounted upon the innermost bearing support surface 182 of the internally threaded female member 181, supporting the female member 181 and spline 178 upon the side plate 94 to which is affixed a further bearing retaining plate 189. A further bearing assembly 185 is mounted upon the remaining end of the female member 181 and supports the female member 181 and spline 178 at that end through an internally provided bearing surface 186 of a supporting cup member 187 which is mounted upon the side plate 94 by a supporting bracket 188.

The arcuately arranged magnet means 89 mounted within the main developer transporting drum 90 extends circumferentially about the interior of the drum 90 from a point proximate the inclined portion 125 of the central chute member 122 to a location adjacent the electrode 102 mounted within the drum 90. As best illustrated in FIG. 7, the arcuately arranged magnet means 89 includes a plurality of elongate transverse segments 190, each of which includes a central permanent magnet core 191, preferably of ceramic magnetic material. Each of the cores 191 are transversely magnetized with opposite poles at opposite sides thereof and elongate soft iron or high permeability material pole pieces 192 are affixed to each side of the cores 191. Like poles of each of the segments 190 are mounted adjacent each other to obtain maximum field strength in the area of the transported developer mix and the segments 190 are affixed to a pair of mounting plates 193 and 194 by threaded members 195. The plates 193 and 194 are stationary and may be phenolic or of suitably selected material and the plates 193 and 194 are affixed to a pair of flanged central mounting members 195 and 196, respectively. A transversely extending mounting shaft 197 extends between the side plates 94 and 95 and through bores 198 and 199 formed centrally in the flanged supporting members 195 and 196, respectively. The flanged supporting members 195 and 196 are affixed to the shaft 197 as indicated at 201. The supporting shaft 197 is mounted at one end thereof by the side plate 95 and a key 202 affixed to the side plate 95 extends into a slot provided in the shaft 197, preventing axial movement of the shaft 197. At its remaining end, the shaft 197 is mounted by the supporting cup 187. The flanged central supporting member 174 which is connected with the drum 90 via the plate 171 is provided with a central bore 203 having an inside diameter greater than the outside diameter of the shaft 197 extending therethrough and, similarly, the spline 178 is provided with a central bore 204 clearing the shaft 197 extending therethrough at the remaining end of that shaft. The flanged supporting member 174 and the spline 178, then, are free for rotational movement about the shaft 197 without contacting that shaft.

The threaded female member 181 mounted upon the spline 178 has affixed thereto first and second sprockets 205 and 206. The sprocket 205 has entrained thereabout a drive chain 207, best seen in FIGS. 5 and 10, the chain 207 being driven from a suitably selected motive source, such as, for example, the motor 208 shown in FIG. 1. The chain 207, then, imparts rotary movement to the drum 90 via the threaded female member 181 mounted upon the spline 178 and the drum supporting plate 172 affixed to the spline 178 and the interior of the drum 90.

Figure 8:
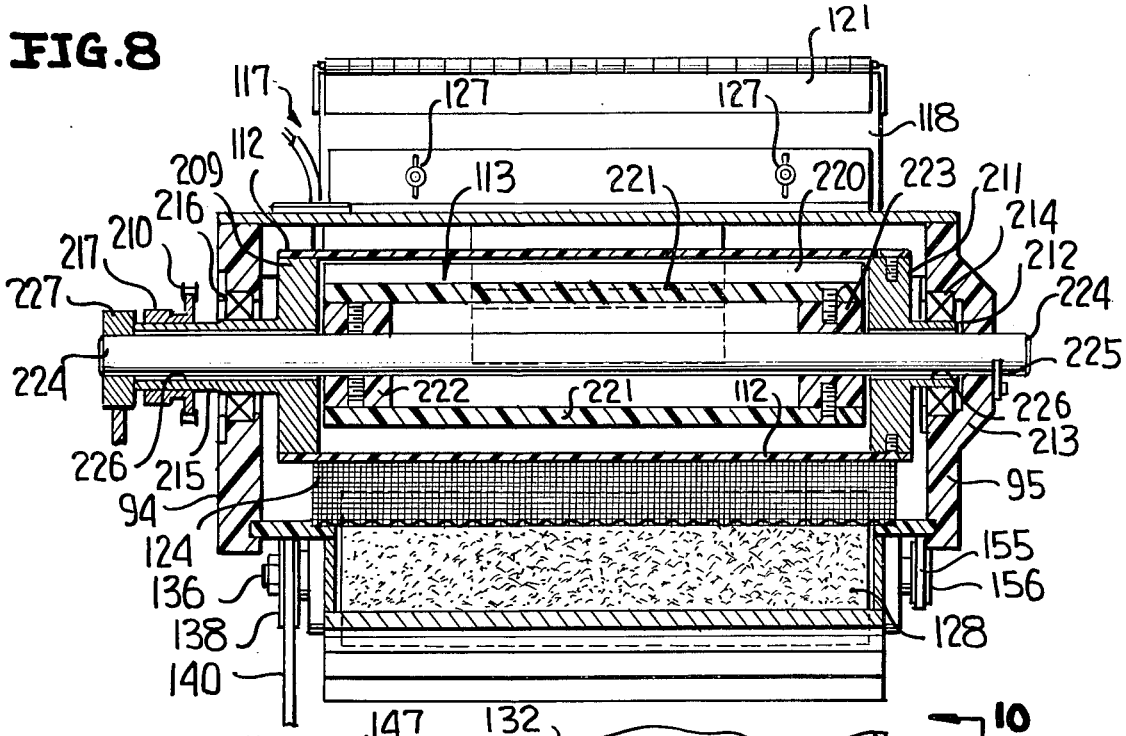
FIG. 8 is a fragmentary sectional view taken along the line 8—8 of FIG. 4 and illustrates the mounting provisions for both the secondary drum and the magnet arrangement within the secondary drum.

The second sprocket 206 mounted upon the threaded female member 181 has entrained thereabout a driven chain 210 which drives the secondary drum 112 for the removal of developer from the surface 91 of the main developer transporting drum 90. As best illustrated in FIG. 8, the secondary drum 112 is mounted in a fashion similar to the mounting of the main drum 90. A secondary drum supporting plate 211 is affixed to the interior of the drum 112 and has an axially extending portion 212 projecting into a bearing housing portion 213 of the side plate 95. A bearing assembly 214 supports the plate 211 for rotary movement with respect to the side plate 95 and at the remaining end of the drum 112 a splined supporting plate 209 is affixed to the interior of the drum 112 and includes axially extending spline portion 215 extending through the side plate 94. A bearing assembly 216 mounts the plate 209 for rotary movement with respect to the side plate 94 and a sprocket 217 is fixedly mounted upon the exterior extension of the splined portion 215 of the mounting plate 214. Again as better illustrated in FIGS. 5 and 10, the driven chain 210 is entrained about the sprocket 217 for imparting rotary motion to the secondary drum 112 from the second sprocket 206 which, in turn, is driven by the threaded female member 181 and its associated chain drive.

The magnet means 113 mounted within the secondary drum 112 includes a plurality of elongate magnet segments 220 arranged circumferentially within the interior of the drum 112 and extending from a point adjacent the point at which the drums 112 and 90 are closest to a location adjacent the uppermost portion of the drum 112. The elongate segments 220 may be of a configuration similar to the configuration of the magnet segments 190 within the main drum 90 and are supported upon the exterior surface of a cylindrical mounting member 221 coaxial with the secondary drum 112. A pair of annular end support members 222 and 223 mounted upon a transverse shaft 224 support the cylindrical member 221 at each end thereof. The shaft 224 extends through and is supported by the side plate 95 and is affixed to the side plate 95 as a key 225 preventing axial movement of the shaft 224. The plate 211 supporting the secondary drum 112 has a bore 225 provided therethrough which clears the shaft 224 for rotation thereabout and, similarly, the splined plate 214 has a bore 226 through which the shaft 224 extends, again clearing the shaft 224 for rotational movement thereabout. A further support member 227 engages the remaining end of the shaft 224 providing support for the shaft proximate the side plate 94.

Preferably, the clearance between the exterior surface 91 of the main drum 90 and the exterior surface 114 of the secondary drum 112 is maintained at a minimum, reducing insofar as possible the quantity of developer which passes the secondary drum 112 on the surface of the main drum 91. Developer leaving the printing or coating zone 80 and approaching the secondary drum 112 while disposed upon the surface 91 of the main drum 90 is drawn magnetically to the surface 114 of the secondary drum 112 by the magnet means 113 and rotation of the secondary drum 112 effects, by frictional engagement with the developer attracted to the surface thereof, movement of the developer away from the main drum 90 for detection of the ratio of carrier and toner particles by the probe 116 and replenishment of toner by the brush 128 prior to re-use in the printing or coating zone 80.

Proximate the printing or coating zone 80, it will be noted the electrode 102 mounted within the main drum 90 is supported by a transversely extending support member 228 which spans the main drum supporting plates 171 and 172. Electrical connection to the electrode 102 may be made via a terminal such as the threaded stud 230 connected with the electrode 102, extending radially inwardly therefrom and having threaded female connectors or nuts 231 thereon.

In an operative embodiment, a potential of −18KV was applied to the electrode 102 during printing intervals, the screen electrode 100 was maintained at a potential of −4KV while metallic can bodies to which toner was applied were maintained at ground potential. Cleaning of the screen electrode was effected by the application of a +10KV potential to the electrode 102 during cleaning intervals. The screen electrode 100 was spaced ¼" from both the coating drum and the surface being coated. Nickel powder carrier particles, commercially available as, for example, from the Sherritt Gordon Company Mines, Ltd., Alberta, Canada, were employed having diameters in the range 2.9 to 3.5 thousandths of an inch as determined by passage through a 170 mesh screen and failure to pass a 200 mesh screen. Also employed in the developer were blue pigmented epoxy toner particles having an average particle size of 30 microns such as are designated 66-1-28A by IPI Division of Interchemical Corp. The preferred developer constituents were 1750 grams of carrier to 85 grams of toner.

The potential applied to the developer in the printing or coating zone 80 is capacitively coupled to the developer mix upon interpositioning of the developer mix between the electrode 102 and the screen electrode 100 and with a ¼" aperture provided by the masking member 101, a 3/16 " wide stripe was provided on the seam area 82 on the containers 23. The reduction in width of the stripe with respect to the width of the aperture 102 provided in the masking member 101 results from the focusing effect provided by field convergence producing beveled or inclined surfaces 111 in the printing or coating zone 80.

Turning to FIGS. 11 and 12, there is illustrated therein printing or coating apparatus of the type discussed hereinabove and including novel developer recirculation provisions and novel means whereby the developer may be completely removed from the printing or coating device. Located proximate the exterior surface 91 of the drum 90 following the printing or coating area 80 is a secondary drum 235 which may be mounted in a fashion similar to the mounting of the secondary drum 112 as discussed hereinabove. Within the secondary drum 235, magnet means 236 including a plurality of circumferentially disposed elongate segments 237 extend from adjacent the point where the main and secondary drums are closest to a point adjacent a further area where removal of developer from the secondary drum 235 is to occur.

The secondary drum 235 rotates in a rotational direction opposite the rotational direction of the main drum 90. That is, as illustrated in FIG. 11, the main drum 90 rotates clockwise while the secondary drum 235 rotates counter-clockwise. Where the exterior surfaces of the two drums 90 and 235 are closest, then, their direction of movement is substantially parallel and on abrupt reversal of direction of movement of the developer is necessary for transfer of the developer to the secondary drum 235 and for transportation of the developer away from the main drum 90. Thus, a smooth gradual change in direction of developer flow is provided, reducing developer agitation or turbulence and, consequently, reducing the effects of such agitation or turbulence such as the grinding together of developer particles commonly resulting in what is known as carrier aging whereby carrier particles after a period of use exhibit a thin coating of toner material thereon which is not removed in ordinary printing or coating operations.

A further gradual change in direction of developer flow is effected by the provision of a third rotatable drum 238 rotatable in opposite rotational direction with respect to the secondary drum 235 and including therein further magnet means 240 extending from adjacent the point at which the drums 235 and 238 are closest to a further area where the conveyed developer is allowed to naturally leave the third drum 238 by gravity and momentum for passage past the toner replenishing provisions mounted within the toner reservoir 117.

Here again it will be noted that the direction of movement of the exterior surface of the drums 235 and 238 where they are closest is substantially parallel, again reducing turbulence and agitation of the conveyed developer and limiting the effects of carrier aging.

The secondary and third drums 235 and 238, respectively, may be housed within a housing portion 241 constructed to conform with the exterior surfaces of the drums 90, 235 and 238 and further facilitating the passage of developer along the predetermined recirculation path therefor. The housing portion 241 may be provided with a surface 242 slightly removed from the exterior surface 91 of the drum 90, permitting the passage of developer therebetween and a second surface 243 may be provided upon the housing portion 241 opposite the area of closest proximity of the drums 90 and 235 to substantially prevent the passage of developer with the exterior surface 91 of the drum 90 away from the secondary drum. A surface 244 conforming to the exterior surface of the secondary drum 235 may be spaced from the exterior surface of the drum 235 to define the path of movement of the developer with the drm 235 away from the main drum 90 and the point of intersection 245 of the surfaces 243 and 244 acts substantially as a doctor blade aiding movement of the developer away from the main drum 90.

Similarly, a surface 246 lies very closely proximate the exterior surface of the drum 235 preventing developer movement therebetween and a surface 247 conforming to the exterior of the third drum 238 is spaced from the drum 238 defining the path of movement of the developer with the exterior of the third drum. Again, the intersection 248 of the surfaces 236 and 247 act as a doctor blade with respect to the drum 235 aiding in the removal of developer from that drum and passage of the developer with the third drum 238.

Finally, a surface 250 very closely proximate the exterior of the third drum 238 substantially prevents developer passage between the surface 250 and the drum 238 and a surface 251 lying parallel to the inclined portion 125 of the central chute member 122 permits movement of developer along the inclined portion 125 for replenishment of toner from the reservoir 117. The surfaces 250 and 251 intersect at 253 to effectively define a doctor blade 253 aiding in the directing of developer along the inclind portion 125 of the housing 122.

Efficient removal of developer from the printing or coating apparatus for replacement or cleansing thereof is provided by developer removal means generally indicated by the numeral 254, including an aperture 255 communicating between the exterior of the printing or coating device and the interior thereof proximate the outer surface of the third drum 238. The aperture 255 may be provided by the inclusion of a further housing member 259 especially provided and affixed to the housing portion 241. Pivotally mounted within the aperture or opening 255, as by mounting upon a shaft 256, is a member 257 having an interior surface 258 conforming to the surface 247 of the housing portion 241 proximate the third drum 238 and, in the position illustrated in FIG. 11, defining a portion of the channel through which the developer moves while supported upon the exterior surface of the third drum 238.

As best seen in FIG. 12, the member 257 may be pivoted to open the aperture 255 wherein a surface 260 diverts movement of carrier through the aperture 255 to the exterior of the printing or coating device. The intersection 261 of the surfaces 258 and 260 defines a further doctor blade engageable with the exterior surface of the drum 238 for complete removal of developer from the surface of that drum. Return pivotal movement of the member 257, of course, effects closure of the aprerture 255 preventing loss of developer in operation of the over-all apparatus.

While the structures and arrangements described hereinabove represent preferred forms of the invention, it will be readily apparent to those skilled in the art that variations may be made in such structures and arrangements without departure from the scope and spirit of the invention incorporated therein.

We claim:

1. Electrostatic printing or coating apparatus for electrostatically depositing toner on portions of continuously conveyed articles comprising means for conveying articles along a predetermined path of travel through a toner application zone, means for transporting toner through said toner application zone, means for electrostatically propelling said toner in said toner application zone from said transporting means to articles conveyed along said path of travel, means defining an elongated narrow opening in said toner application zone between said transporting means and said conveying means whereby only the propelled toner passing through said opening is deposited upon said articles, the longitudinal axis of said opening is disposed in generally parallel relationship to said path of travel, said transporting means includes an endless moving surface upon which is supported said toner, and a portion of said endless moving surface is disposed adjacent said narrow opening and moves past said narrow opening in a direction transverse to the longitudinal axis thereof.

2. The apparatus as defined in claim 1 wherein said toner is defined by toner particles carried by magnetic carrier particles, and magnetic means downstream of said toner application zone for magnetically attracting said carrier particles and toner particles carried thereby against said endless moving surface prior to the transporting thereof into said toner application zone.

3. The apparatus as defined in claim 1 wherein said toner is defined by toner particles carried by magnetic carrier particles, magnetic means downstream of said toner application zone for magnetically attracting said carrier particles and toner particles carried thereby against said endless moving surface of said transporting means prior to the transporting thereof into said toner application zone, said transporting means endless moving surface being an exterior surface of a drum having an axis of rotation generally parallel to said longitudinal axis, and said magnetic means is stationarily mounted within said drum.

4. The apparatus as defined in claim 1 wherein said articles are tubular bodies having a longitudinal seam, and said conveying means convey said tubular bodies through said toner application zone with the longitudinal seams thereof generally parallel to said longitudinal axis.

5. The apparatus as defined in claim 1 wherein said toner is defined by toner particles carried by magnetic carrier particles which diverge in a direction away from said transporting means under the influence of said electrostatic propelling means, and means for reducing the divergence of the magnetic carrier particles prior to the toner particles being deposited upon said articles.

6. The apparatus as defined in claim 1 wherein said toner is defined by toner particles carried by larger carrier particles, screen means spanning said opening, and said screen means being of a mesh to permit the passage of said toner particles therethrough while preventing the passage of carrier particles therethrough whereby generally only toner particles are deposited upon said articles.

7. The apparatus as defined in claim 1 wherein said toner is defined by toner particles carried by larger carrier particles, said opening is defined by an unmasked portion of a screen, and said screen is of a mesh to permit the passage of said toner particles therethrough while preventing the passage of carrier particles therethrough whereby generally only toner particles are deposited upon said articles.

8. The apparatus as defined in claim 1 including a housing, said transporting means being housed in said housing, a portion of said housing and said endless moving surface of said transporting means defining a gap through which said toner passes during the transport thereof toward said toner application zone, and means for varying the size of said gap to regulate the level of toner carried upon said endless moving surface into said toner application zone.

9. The apparatus as defined in claim 1 including a housing, said transporting means being housed in said housing, a portion of said housing and said endless moving surface of said transporting means defining a gap through which said toner passes during the transport thereof toward said toner application zone, means for varying the size of said gap to regulate the level of toner carried upon said endless moving surface into said toner application zone, said size varying means being a doctor blade, and means mounting said doctor blade for adjustable pivotal movement to selectively vary the size of said gap.

10. The apparatus as defined in claim 1 including a housing, said transporting means being housed in said housing, a portion of said housing and said endless moving surface of said transporting means defining a gap through which said toner passes during the transport thereof toward said toner application zone, means for varying the size of said gap to regulate the level of toner carrier upon said endless moving surface into said toner application zone, said size varying means being a doctor blade, means mounting said doctor blade for adjustable pivotal movement to selectively vary the size of said gap, means in said housing for removing toner from said endless moving surface of said transporting means at a position beyond said toner application zone, a second portion of said housing and said toner removing means defining a second gap through which removed toner passes, means contiguous said second gap for determining the quality of said toner, means responsive to said quality determining means for feeding additional toner for admixture with the removed toner when the quality of the latter so dictates, and means for conducting said additional toner into said housing at a point beyond said second gap as viewed in the direction of movement of the removed toner therethrough.

11. The apparatus as defined in claim 2 wherein said articles are tubular bodies having a longitudinal seam, and said conveying means convey said tubular bodies through said toner application zone with the longitudinal seams thereof generally parallel to said longitudinal axis.

12. The apparatus as defined in claim 2 wherein said toner is defined by toner particles carried by magnetic carrier particles which diverge in a direction away from said transporting means under the influence of said electrostatic propelling means, and means for reducing the divergence of the magnetic carrier particles prior to the toner particles being deposited upon said articles.

13. The apparatus as defined in claim 2 wherein said toner is defined by toner particles carried by larger carrier particles, screen means spanning said opening, and said screen means being of a mesh to permit the passage of said toner particles therethrough while preventing the passage of carrier particles therethrough whereby generally only toner particles are deposited upon said articles.

14. The apparatus as defined in claim 2 wherein said toner is defined by toner particles carried by larger carrier particles, said opening is defined by an unmasked portion of a screen, and said screen is of a mesh to permit the passage of said toner particles therethrough while preventing the passage of carrier particles therethrough whereby generally only toner particles are deposited upon said articles.

15. The apparatus as defined in claim 2 including a housing, said transporting means being housed in said housing, a portion of said housing and said endless moving surface of said transporting means defining a gap through which said toner passes during the transport thereof toward said toner application zone, and means for varying the size of said gap to regulate the level of toner carried upon said endless moving surface into said toner application zone.

16. The apparatus as defined in claim 3 wherein said articles are tubular bodies having a longitudinal seam, and said conveying means convey said tubular bodies through said toner application zone with the longitudinal seams thereof generally parallel to said longitudinal axis.

17. The apparatus as defined in claim 3 wherein said toner is defined by toner particles carried by magnetic carrier particles which diverge in a direction away from said transporting means under the influence of said electrostatic propelling means, and means for reducing the divergence of the magnetic carrier particles prior to the toner particles being deposited upon said articles.

18. The apparatus as defined in claim 3 wherein said toner is defined by toner particles carried by larger carrier particles, screen means spanning said opening, and said screen means being of a mesh to permit the passage of said toneer particles therethrough while preventing the passage of carrier particles therethrough whereby generally only toner particles are deposited upon said articles.

19. The apparatus as defined in claim 3 wherein said toner is defined by toner particles carried by larger carrier particles, said opening is defined by an unmasked portion of a screen, and said screen is of a mesh to permit the passage of said toner particles therethrough while preventing the passage of carrier particles therethrough whereby generally only toner particles are deposited upon said articles.

20. The apparatus as defined in claim 1 wherein said toner is defined by toner particles carried by larger magnetic carrier particles, magnetic means downstream of said toner application zone for magnetically attracting said carrier particles and toner particles carried thereby against said endless moving surface of said transporting means prior to the transporting thereof into said toner application zone, said transporting means being an endless conveyor having said endless moving surface which moves generally transverse to said longitudinal axis, said articles are tubular bodies having a longitudinal seam, said conveying means convey said tubular bodies through said toner application zone with the longitudinal seams thereof generally parallel to said longitudinal axis, said toner diverges in a direction away from said endless conveyor surface under the influence of said electrostatic propelling means, means for reducing the divergence of said toner prior to the latter being deposited upon said articles, screen means spanning said opening, and said screen means being of a mesh to permit the passage of said toner particles therethrough while preventing the passage of carrier particles therethrough whereby generally only toner particles are deposited upon said articles.

21. The apparatus as defined in claim 1 including a housing, said transporting means being housed in said housing, a portion of said housing and said endless moving surface of said transporting means defining a gap through which said toner passes during the transport thereof toward said toner application zone, and means for varying the size of said gap to regulate the level of toner carried upon said endless moving surface of said transporting means into said toner application zone.

22. The apparatus as defined in claim 20 including a housing, said transporting means being housed in said housing, a portion of said housing and said endless moving surface of said transporting means defining a gap through which said toner passes during the transport thereof toward said toner application zone, means for varying the size of said gap to regulate the level of toner carried upon said endless moving surface of said transporting means into said toner application zone, said size varying means being a doctor blade, and means mounting said doctor blade for adjustable pivotal movement to selectively vary the size of said gap.

23. The apparatus as defined in claim 20 including a housing, said transporting means being housed in said housing, a portion of said housing and said endless moving surface of said transporting means defining a gap through which said toner passes during the transport thereof toward said toner application zone, means for varying the size of said gap to regulate the level of toner carrier upon said endless moving surface of said transporting means into said toner application zone, said size varying means being a doctor blade, means mounting said doctor blade for adjustable pivotal movement to selectively vary the size of said gap, means in said housing for removing toner from said transporting means at a position beyond said toner application zone, a second portion of said housing and said toner removing means defining a second gap through which removed toner passes, means contiguous said second gap for determining the quality of said toner, means responsive to said quality determining means for feeding additional toner for admixture with the removed toner when the quality of the latter so dictates, and means for conducting said additional toner into said housing at a point beyond said second gap as viewed in the direction of movement of the removed toner therethrough.

24. Electrostatic printing or coating apparatus including means for transporting toner composed of toner particles carried by magnetic carrier particles to a toner application zone, means for electrostatically applying said toner particles to at least a portion of an article in said toner application zone, means for establishing an dectric field in said toner application zone for propelling said magnetic carrier particles in a divergent fashion from said transporting means toward an article, and means for reducing the divergence of the magnetic carrier particles during the propulsion thereof toward an article.

25. The apparatus as defined in claim 24 wherein said divergence reducing means effects convergence of said electrical field in a direction toward said articles.

26. The apparatus as defined in claim 25 wherein said divergence reducing means include means defining an opening through which said toner is propelled, said opening being defined by sides sloping toward said opening and facing away from said transporting means.

27. The apparatus as defined in claim 25 wherein said toner particles are smaller than said magnetic carrier particles, means defining an opening, a screen across said opening of a mesh to permit the passage of said toner particles therethrough whereby generally only toner particles are deposited upon said articles, and said screen and openig defining means being at the same electrical potential.

28. The apparatus as defined in claim 26 wherein said toner particles are smaller than said magnetic carrier particles, a screen across said opening of a mesh to permit the passage of said toner particles therethrough whereby generally only toner particles are deposited upon said articles, and said screen and opening defining means being at the same electrical potential.

29. Electrostatic printing or coating apparatus for electrostatically depositing toner on portions of continuously conveyed articles including conveying means for conveying said articles along a predetermined path, means for transporting toner particles into an application zone proximate said path, means for electrostatically applying said toner particles to said portions of articles including opening means communicating between said transporting means and said path for the passage of toner particles therethrough, said communicating means between said transporting means and said path including an elongagted opening lying parallel to said path for defining the portions of the articles to be coated, said transporting means including a movable member having a portion thereof for carrying toner particles on a surface thereof proximate said opening means, magnetic means proximate said movable member for effecting the locating of toner particles on said surface of said movable member, means defining a housing for said transporting means, cleaning means comprising doctor blade means movable into the path of movement of toner particles within said housing, means movable to define a toner particle removal opening through said housing, and said doctor blade means being positioned for diverting said toner particles through said particle removal opening.

30. The apparatus as defined in claim 29 wherein said movable means defining said particle removal opening comprises a member pivotally mounted upon said housing means for extension into said housing means, and said doctor blade means being defined by an edge of said pivotally mounted member for movement into said path of movement of toner particles upon extension of said member into said housing means.

31. The apparatus as defined in claim 29 wherein said movable member comprises a drum having an axis of rotation generally parallel to said opening, and said magnetic means being fixedly mounted within said drum.

* * * * *